US011508305B2

(12) United States Patent
Lin et al.

(10) Patent No.: US 11,508,305 B2
(45) Date of Patent: Nov. 22, 2022

(54) LIGHT EMITTING DIODE DISPLAY AND DRIVING METHOD THEREOF FOR REDUCING BRIGHTNESS CHANGE DUE TO REFRESH RATE VARIATION

(71) Applicant: NOVATEK MICROELECTRONICS CORP., Hsinchu (TW)

(72) Inventors: Huifeng Lin, Taichung (TW); Yen-Tao Liao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 163 days.

(21) Appl. No.: 16/996,821

(22) Filed: Aug. 18, 2020

(65) Prior Publication Data

US 2021/0201793 A1 Jul. 1, 2021

Related U.S. Application Data

(60) Provisional application No. 62/953,805, filed on Dec. 26, 2019.

(51) Int. Cl.
*G09G 3/3258* (2016.01)

(52) U.S. Cl.
CPC ..... *G09G 3/3258* (2013.01); *G09G 2310/08* (2013.01); *G09G 2320/0653* (2013.01)

(58) Field of Classification Search
CPC ..... G09G 3/3258; G09G 2310/08; G09G 2320/0653
See application file for complete search history.

(56) References Cited

U.S. PATENT DOCUMENTS

| | | | | |
|---|---|---|---|---|
| 9,620,064 | B2 | 4/2017 | Albrecht et al. | |
| 2004/0183821 | A1* | 9/2004 | Woo | H05B 47/19 345/691 |
| 2018/0284876 | A1 | 10/2018 | Ray et al. | |

FOREIGN PATENT DOCUMENTS

| | | | |
|---|---|---|---|
| CN | 107481688 | | 12/2017 |
| CN | 105074807 | | 1/2018 |
| CN | 108806620 | | 11/2018 |
| CN | 108806620 | A * | 11/2018 |
| CN | 109147714 | | 1/2019 |
| TW | 201447842 | | 12/2014 |

OTHER PUBLICATIONS

"Office Action of Taiwan Counterpart Application", dated Nov. 19, 2021, p. 1-p. 6.

* cited by examiner

*Primary Examiner* — Michael Pervan
(74) *Attorney, Agent, or Firm* — JCIPRNET

(57) ABSTRACT

A driving method of LED display, configured to be applied to an LED display capable of varying a refresh rate thereof and able to reduce brightness changes due to refresh rate variation, is disclosed in the present disclosure. This driving method includes: controlling an organic light-emitting diode of the LED display by an emission signal having a plurality of frame periods, with each of the frame periods having a PWM part with a duty ratio; detecting whether a change in the refresh rate of the LED display exists; and performing a compensation procedure when the change is detected, with the compensation procedure compensating a brightness difference of the organic light-emitting diode occurring due to the change in the refresh rate by adjusting the duty ratio of the PWM part. Said LED display is also disclosed.

25 Claims, 8 Drawing Sheets

LIGHT EMITTING DIODE DISPLAY AND DRIVING METHOD THEREOF FOR REDUCING BRIGHTNESS CHANGE DUE TO REFRESH RATE VARIATION

CROSS-REFERENCE TO RELATED APPLICATIONS

This non-provisional application claims priority under 35 U.S.C. § 119(a) on Patent Application No. 62/953,805 filed in US on Dec. 26, 2019, the entire contents of which are hereby incorporated by reference.

BACKGROUND

1. Technical Field

The disclosure relates to a light emitting diode (LED) display with variable refresh rate and a driving method thereof, more particularly to an LED display device and a driving method thereof for reducing brightness changes due to refresh rate variation.

2. Related Art

With the need of display devices capable of varying refresh rate frequently for different usages such as for movies, document works, video games etc., the change in brightness due to refresh rate variation becomes an annoying problem to the users, and thus more and more display manufacturers are eager to solve this problem for marketing reasons. A reason why there is a brightness change occurring when the refresh rate of a light emitting diode (LED) display (e.g., an organic light emitting diode (OLED) display) changes lies in that the length of a programming part of the emission signal, which can be understood as the vertical blank interval, is usually changed in response to the refresh rate variation. Namely, a programming part corresponding to a frame shown right after a change in refresh rate is usually longer or shorter than a last programming part corresponding to a last frame shown before the change.

Specifically, due to the difference in lengths of the programming parts, the length of a pulse width modulation (PWM) part of the emission signal, which can be understood as the data enable period, is also shortened or lengthened since the time period of each frame is kept constant. Thus, when the PWM part corresponding to the frame shown right after the change in refresh rate is shorter than the last PWM part corresponding to the last frame shown before the change due to a lengthened programming part, the length of the last on-duration of the PWM part after the change in refresh rate must be shorter than that of the PWM part before the change, and vice versa. As a result, the shorter or longer last on-duration of the PWM part after the change in refresh rate leads to the change in brightness since the total time for an LED receiving the emission signal to emit light is changed.

SUMMARY

A driving method of LED display, configured to be applied to an LED display capable of varying a refresh rate thereof and able to reduce brightness changes due to refresh rate variation, is disclosed according one embodiment of the present disclosure. This driving method includes: controlling an organic light-emitting diode of the LED display by an emission signal having a plurality of frame periods, with each of the frame periods having a PWM part with a duty ratio; detecting whether a change in the refresh rate of the LED display exists; and performing a compensation procedure when the change is detected, with the compensation procedure compensating a brightness difference of the organic light-emitting diode occurring due to the change in the refresh rate by adjusting the duty ratio of the PWM part.

A driving method of LED display, configured to be applied to an LED display capable of varying a refresh rate thereof and able to reduce brightness changes due to refresh rate variation, is disclosed according another embodiment of the present disclosure. This driving method includes: controlling an organic light-emitting diode of the LED display by an emission signal having a plurality of frame periods, with each of the frame periods having a PWM part with a duty ratio; and changing the duty ratio from an initial duty ratio to a final duty ratio when a change in the refresh rate of the LED display exists.

An LED display capable of varying a refresh rate thereof and able to reduce brightness changes due to refresh rate variation is disclosed according another embodiment of the present disclosure. This LED display includes an LED panel and a controller. The LED panel has a plurality of pixels. The controller electrically connects with the pixels. The controller generates an emission signal having a plurality of frame periods and sends the emission signal to one of the pixels, with each of the frame periods having a PWM part with a duty ratio, and wherein the controller changes the duty ratio from an initial duty ratio to a final duty ratio when a change in the refresh rate of the LED display exists.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
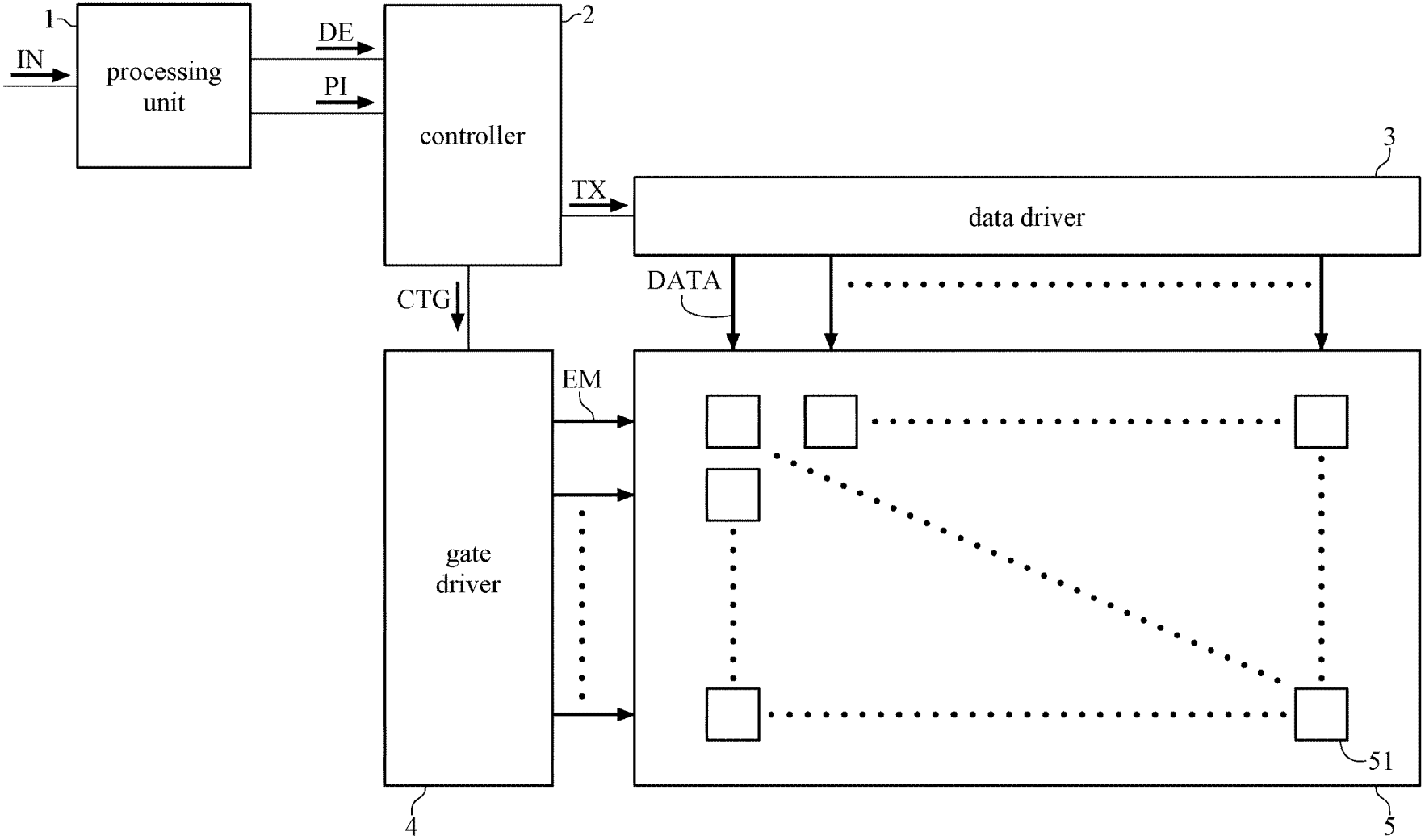
FIG. 1 is a block diagram illustrating an LED display capable of reducing brightness changes due to refresh rate variation according to an embodiment of the present disclosure.
Figure 2:
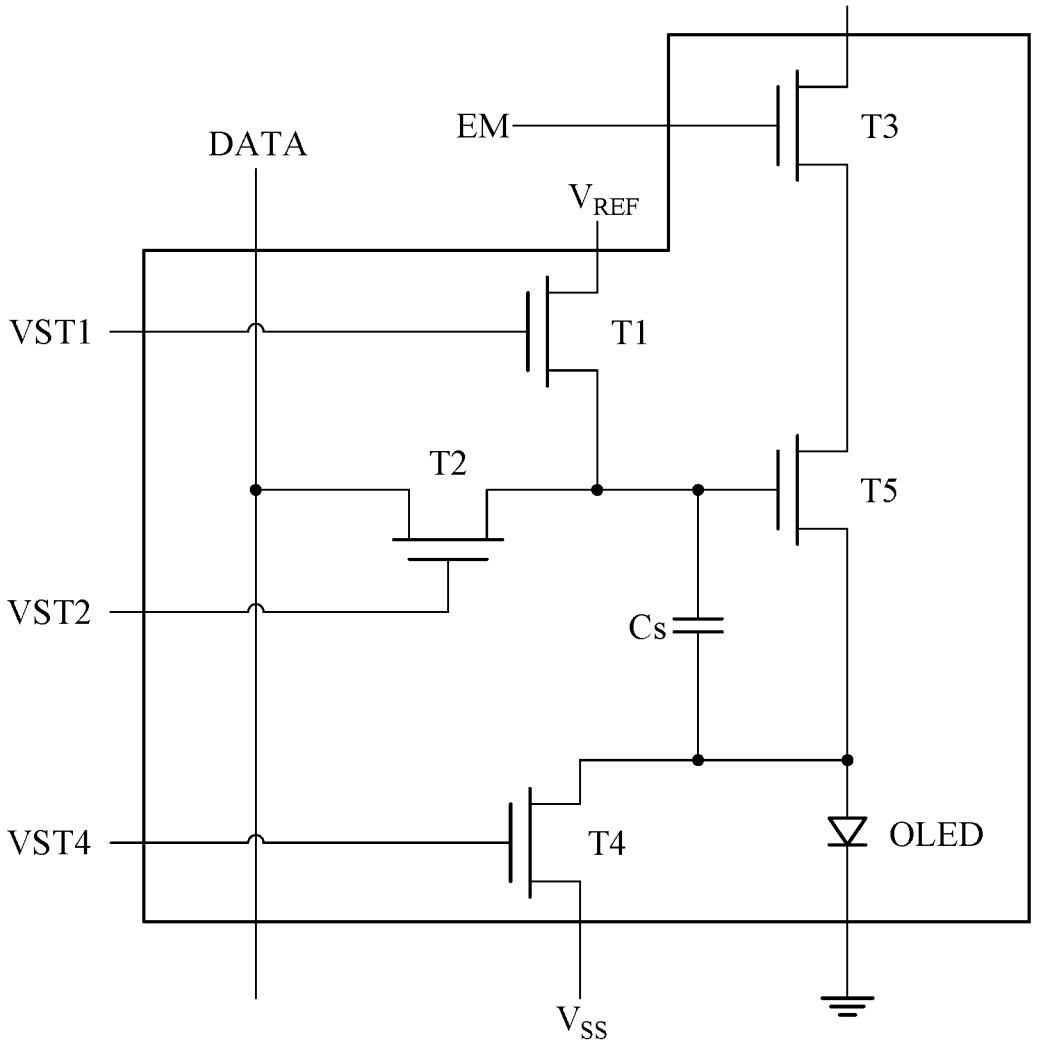
FIG. 2 is a circuit diagram illustrating a pixel of the LED display according to the embodiment of the present disclosure.

Please refer to FIGS. 1 and 2. FIG. 1 shows a block diagram illustrating a light emitting diode (LED) such as an OLED display capable of reducing brightness change due to refresh rate variation according to an embodiment of the present disclosure. FIG. 2 shows a circuit diagram of a pixel of the LED display shown in FIG. 1. In the display device of this embodiment, there are a processing unit 1, a controller 2, a data driver 3, a gate driver 4 and a display panel 5. The processing unit 1 receives an input signal IN and controls the data driver 3 and the data driver 4 via the controller 2 so that the display panel 5 can show frames contained in the input signal IN.

Specifically, the processing unit 1 can receive the input signal IN to generate an image signal PI and a data enable signal DE based on the input signal IN. The image signal PI includes contents of frames to be displayed by the display panel 5. The data enable signal DE is configured to enable a plurality of pixels 51 of the display panel 5 sequentially. Each of said pixels 51 hereafter may represent a pixel of a single-color or a sub-pixel of a multi-color pixel. The controller 2, which can be a timing controller of a common display device, couples with the processing unit 1 and receives the image signal PI and the data enable signal DE sent by the processing unit 1, and the controller 2 further couples with the data driver 3 and the gate driver 4 respectively. Based on the image signal PI and the data enable signal DE, the controller 2 controls the data driver 3 and the gate driver 4 to generate and transmit signals to the display panel 5 coupled with the data driver 3 and the gate driver 4. Regarding the pixels 51 of the display panel 5, each of the pixels 51 is in a 5T1C (five transistors T1-T5 and one capacitor Cs) structure in this embodiment as shown in FIG. 2 and is configured to emit light in a color of a frame pixel by an organic light-emitting diode LED thereof. The structure of each pixel is not limited in the present disclosure and thus the signals sent to the display panel 5 may be different while the pixels 51 with a structure different from 5T1C are applied. The signals sent to each pixel 51 can still include a frame data signal DATA from the data driver 3 and an emission signal EM from the gate driver 4 for different structures of each pixel. Specifically, with this 5T1C structure, the gate driver 4 further sends signal VST1, signal VST2, and signal VST4 to each of the pixels 51 in addition to the emission signal EM for operating the pixels 51 normally. In operation, once the pixels 51 receive the signals from the data driver 3 and the gate driver 4, they can emit light, with the frame data signal DATA controlling the quantity of light emitted by a respective one of the pixels 51, and with the emission signal EM serving to determine the enable time periods of every pixel 51.

Figure 3:
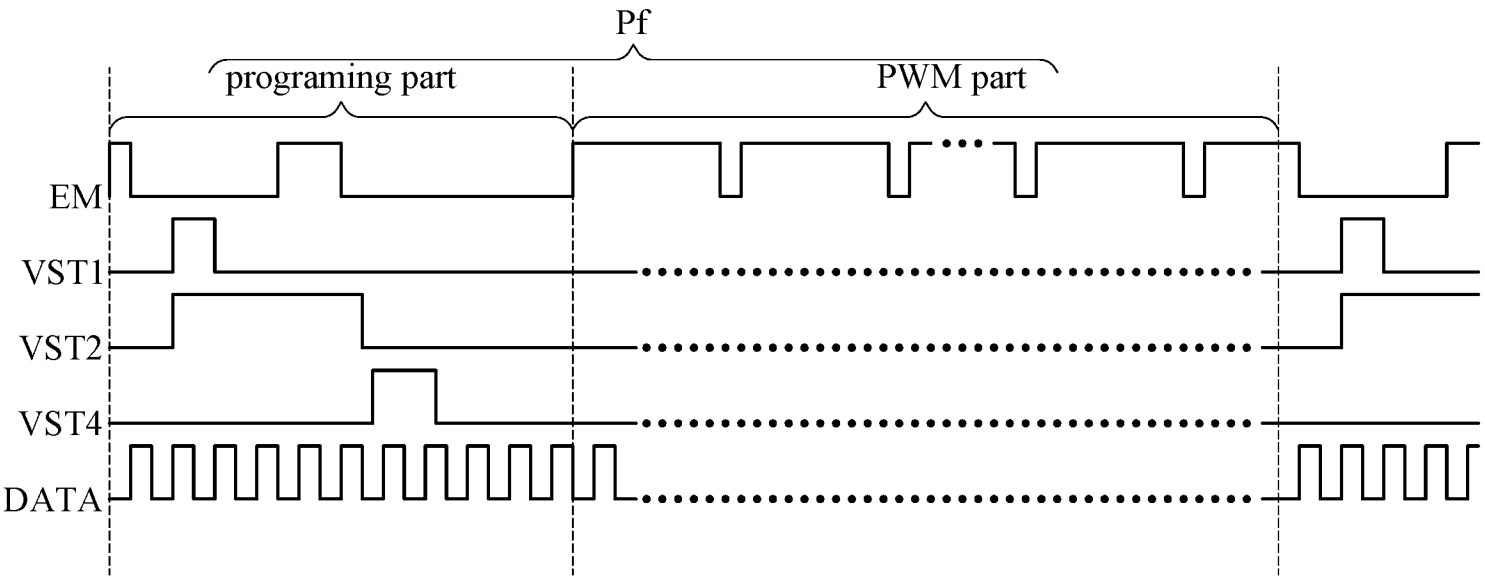
FIG. 3 is a voltage chart of signals sent to the pixel of the LED display according to the embodiment of the present disclosure.

Please refer to FIG. 3, which shows a voltage chart of the signals sent to a pixel 51 including the mission signal EM for a better understanding of the operation. In the present disclosure, the emission signal EM includes a plurality of frame periods Pf for frames to be shown by the display panel 5, while each frame period Pf is divided into a programming part and a PWM part. The programming part is configured for setting the pixel 51 to be ready for light emission, and the PWM part has a duty ratio for activating the pixel 51 to emit light during an on-duration of the PWM part. Specifically, in operation of the LED display, when the refresh rate is changed, the length of the programming part is correspondingly changed, too; namely, the length of the programming part is corresponding to the refresh rate of the LED display. The variation in the length of the programming part led by the change in refresh rate thus causes a change in the length of the PWM part since a total of lengths of the programming part and the PWM part, the length of the frame period Pf namely, remain constant. The following driving method is applied in the present disclosure, which can suppress the difference in the quantities of light emitted by the pixel 51 during the PWM parts before and after the refresh rate variation.

Figure 4:
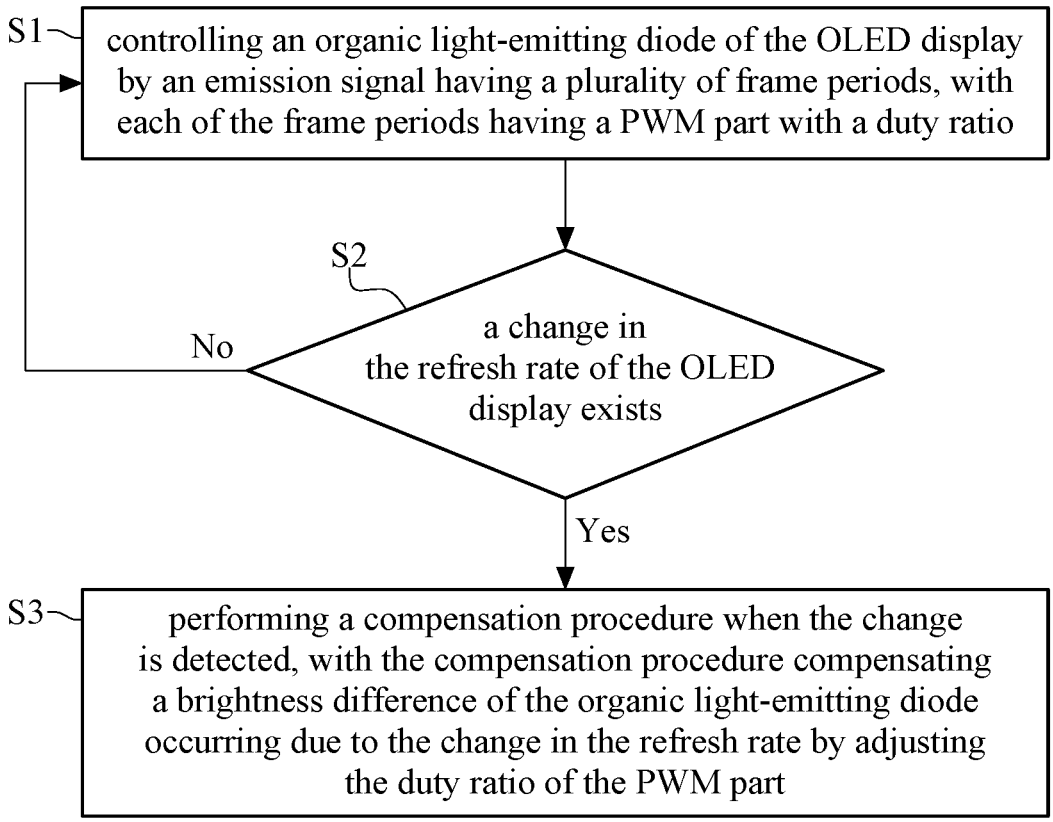
FIG. 4 is a flow chart illustrating the driving method for reducing brightness changes due to refresh rate variation according to an embodiment of the present disclosure.

Please refer to FIGS. 1, 2 and 4, wherein FIG. 4 shows a flow chart illustrating the driving method for reducing brightness change due to refresh rate variation according to an embodiment of the present disclosure. In the step S1, with the controller 2, the organic light-emitting diode LED of the present LED display is controlled by the emission signal EM having said plurality of frame periods Pf, while the PWM part has an initial duty ratio, which can be understood as a duty ratio before a compensation procedure in response to a refresh rate variation. In the step S2, based on the image signal PI and the data enable signal DE, the controller 2 detects whether a change in refresh rate of the LED display exists. Specifically, if the change exists, the refresh rate before the change is defined as a first refresh rate, and a refresh rate with said change is a second refresh rate. In the step S3, the compensation procedure is performed when the controller 2 detects said change in refresh rate. This compensation procedure is applied for compensating the brightness difference of the organic light-emitting diode LED occurring due to the change in refresh rate by adjusting the initial duty ratio of the PWM part to a final duty ratio, which can be understood as a duty ratio after the compensation procedure.

To suppress the brightness change caused by the refresh rate variation, the variation in the length of the programming part and the adjustment of the duty ratio are preferably (but not limitedly) in a positive correlation, so that the adjustment of the duty ratio can compensate the brightness difference of the organic light-emitting diode LED. Specifically, please refer to FIGS. 5A and 5B, both of which show the voltage chart of the emission signal EM before and after the compensation procedure. For the convenience of further discussion, hereafter, the programming part before the compensation procedure will be called as the former programming part; the PWM part before the compensation procedure will be called as the former PWM part; the programming part after the compensation procedure will be called as the latter programming part; and the PWM part after the compensation procedure will be called as the latter PWM part. Moreover, both the former programming part and the former PWM part are in a former frame period Pff, and both the latter programming part and the latter PWM part are in a latter frame period Pfl.

Figure 5A:
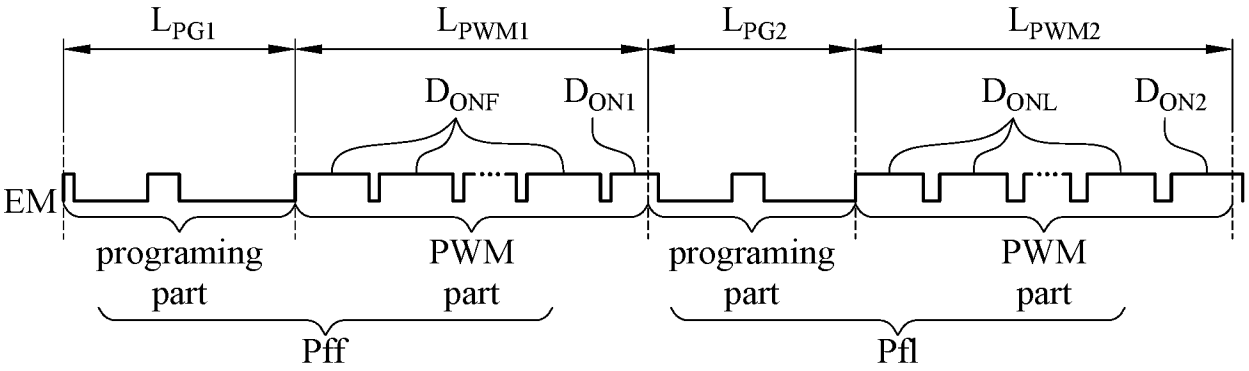
FIG. 5A is a voltage chart of the emission signal when the duty ratio of the PWM part is decreased according to the embodiment of the present disclosure.

In FIG. 5A, the length $L_{PG2}$ of the latter programming part is smaller than the length $L_{PG1}$ of the former programming part due to the refresh rate variation, and thus the length $L_{PWM2}$ of the latter PWM part is larger than the length $L_{PWM1}$ of the former PWM part. As a result, in the compensation procedure, the controller 2 adjusts the duty ratio of the PWM part from the initial duty ratio of the former PWM part to the final duty ratio of the latter PWM part, and the final duty ratio is smaller than the initial duty ratio. With the final duty ratio smaller than the initial duty ratio, although the last on-duration $D_{ON2}$ of the latter PWM part is longer than the last on-duration $D_{ON1}$ of the former PWM part, each of the other on-durations $D_{ONL}$ of the latter PWM part is shorter than the other on-durations $D_{ONF}$ of the former PWM part, thus the increased quantity of light caused by the longer last on-duration of the latter PWM part can be compensated by the decreased quantities of light caused by the shorter other on-durations thereof. Similarly, in FIG. 5B, the length $L_{PG2}$ of the latter programming part is larger than the length $L_{PG1}$ of the former programming part due to the refresh rate variation, and thus the length $L_{PWM2}$ of the latter PWM part is smaller than the length $L_{PWM1}$ of the former PWM part. In the compensation procedure, the controller 2 adjusts the duty ratio of the PWM part from the initial duty ratio of the former PWM part to the final duty ratio of the latter PWM part, and the final duty ratio is larger than the initial duty ratio. Thereby, the decreased quantity of light caused by the shorter last on-duration $D_{ON2}$ of the latter PWM part can be compensated by the increased quantities of light caused by the longer other on-durations $D_{ONL}$ thereof. Theoretically, the driving method of the present disclosure is to compensate the increased/decreased quantity of light due to the longer/shorter last on-duration $D_{ON2}$ of the latter PWM part by the decreased/increased quantities of light due to the shorter/longer other on-durations $D_{ONL}$ as much as possible.

Particularly, it can be understood that a PWM part can be divided into a plurality of fractions while each of a plurality of on-durations of the PWM part occupies a part of the fractions, and the duty ratio of this PWM part can be expressed as a ratio of the number of the fractions of an on-duration to the number of the fractions of a full period of the PWM part, the total fractions of an on-duration and an off-duration. In the compensation procedure of the present disclosure, in some cases, the variation in the length of the programming part cannot be evenly spread into every on-durations because the increased or decreased number of fractions of the latter PWM part is not divisible by the number of on-durations thereof. In these cases, through the compensation procedure, a difference between the variation in the length of the programming part and a total of changes of the plurality of on-durations due to the adjustment of the duty ratio is within a product of a number of the plurality of on-durations and a time period of the fraction. Specifically, in the ideal case, the total of changes of the plurality of on-durations due to the adjustment of the duty ratio is equal to the variation in the length of the programming part leading to the shorter/longer last on-duration of the latter PWM part, which means that the increased or decreased number of fractions of the latter PWM part is divisible by the number of on-durations. In other words, in this ideal case, the variation in the length of the programming part is equal to a total of changes of the plurality of on-durations due to the adjustment of the duty ratio.

Figure 5B:
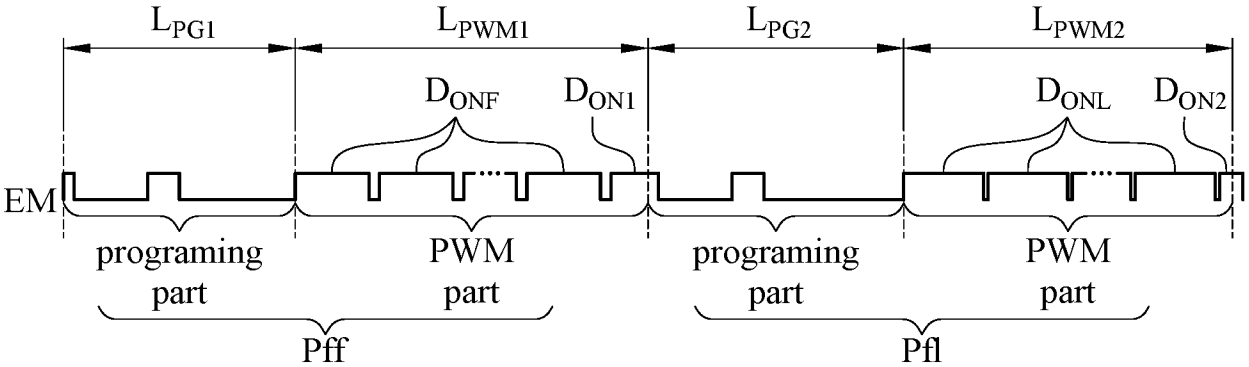
FIG. 5B is a voltage chart of the emission signal when the duty ratio of the PWM part is increased according to the embodiment of the present disclosure.
Figure 6:
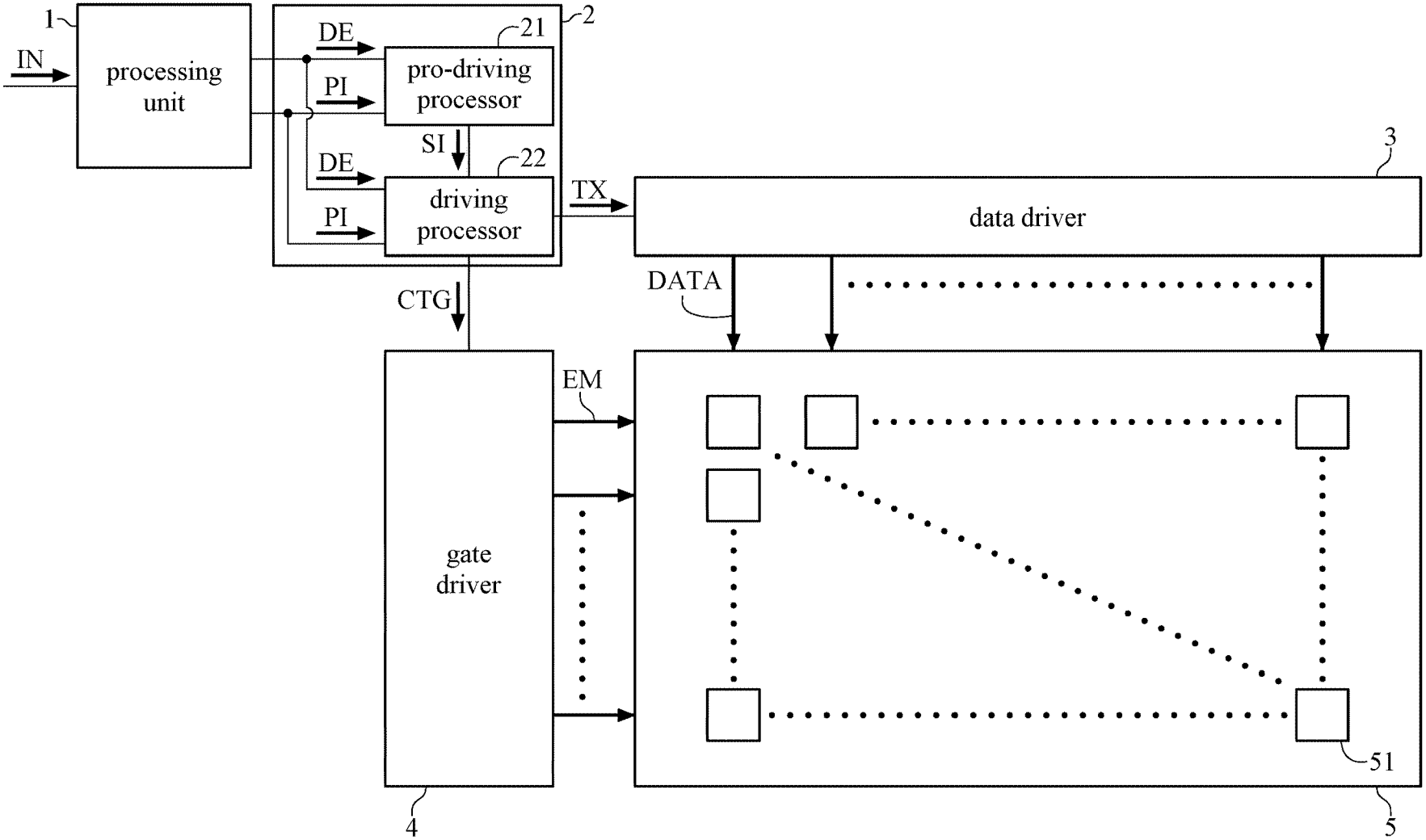
FIG. 6 is a block diagram illustrating an LED display capable of reducing brightness changes due to refresh rate variation according to another embodiment of the present disclosure.

Furthermore, in order to immediately adjust the duty ratio of the on-duration once the refresh rate variation occurs, as what is shown in FIG. 6, the controller 2 may have a pre-driving processor 21 and a driving processor 22. The pre-driving processor 21 electrically connects to the processing unit 1 to receive the image signal PI and the data enable signal DE for detecting whether the change in refresh rate exists. The driving processor 22 couples with the pre-driving processor 21, the processing unit 1, the data driver 3 and the gate driver 4. In operation, the pre-driving processor 21 receives the image signal PI and the data enable signal DE in advance to the driving processor 22 at a first timing, and, when a change in refresh rate is detected, the pre-driving processor 21 calculates the required final duty ratio based on the image signal PI and the data enable signal DE and generates an informing signal SI with information of the final duty ratio. The driving processor 22 receives the image signal PI and the data enable signal DE as well as the informing signal SI at a second timing later than the first timing for at least one frame period, and performs the compensation procedure for generating its outputs to the data driver 3 and the gate driver 4. Thereby, although the outputs to the data driver 3 and the gate driver 4 are delayed a little, the signals generated by the driving processor 22 can immediately change the duty ratio in response to the variation in length of the programming part in the same frame period Pf so as to exactly minimize the brightness change due to refresh rate variation like what is shown in FIGS. 5A and 5B.

Figure 7A:
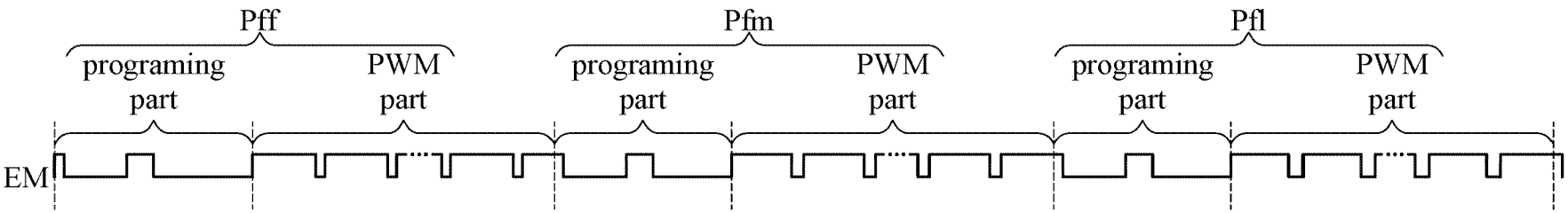
FIG. 7A is a voltage chart of the emission signal when the duty ratio of the PWM part is decreased gradually according to the embodiment of the present disclosure.
Figure 7B:
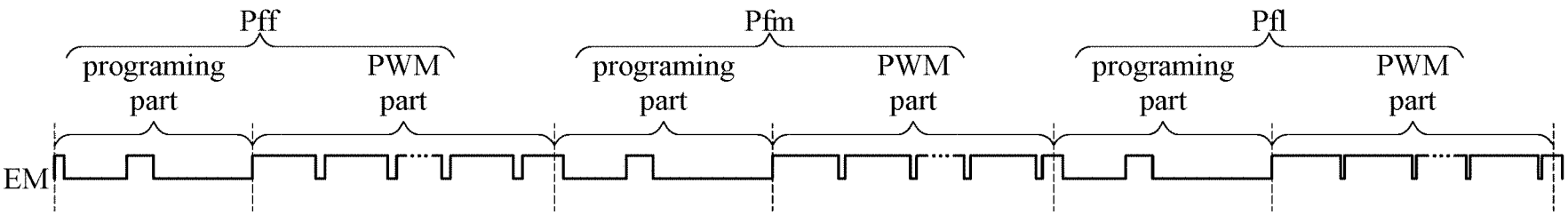
FIG. 7B is a voltage chart of the emission signal when the duty ratio of the PWM part is increased gradually according to the embodiment of the present disclosure.

Another way performed based on the above illustrated structure is shown in FIGS. 7A and 7B. Among the plurality of frame periods Pf, there is a middle frame period Pfm between the former frame period Pff and the latter frame period Pfl, while the middle frame period Pfm has a PWM part with a middle duty ratio between the initial duty ratio and the final duty ratio as shown in FIGS. 7A and 7B. Namely, the duty ratio is gradually adjusted during the compensation procedure. Although FIGS. 7A and 7B only show one middle frame period Pfm between the former frame period Pff and the latter frame period Pfl, there may be more than one middle frame periods Pfm between them, with the middle duty ratios of the PWM parts of these middle frame periods Pfm gradually increased or decreased from the initial duty ratio to the final duty ratio.

Figure 8A:
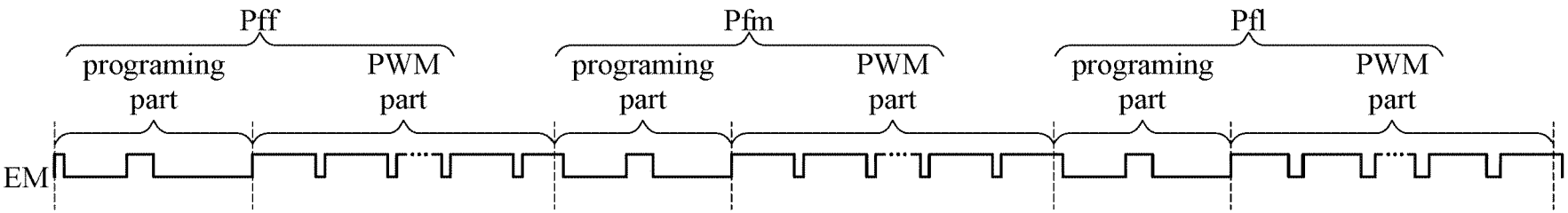
FIGS. 8A and 8B are voltage charts of the emission signals when a pre-driving processor is not applied according to the embodiment of the present disclosure.
Figure 8B:
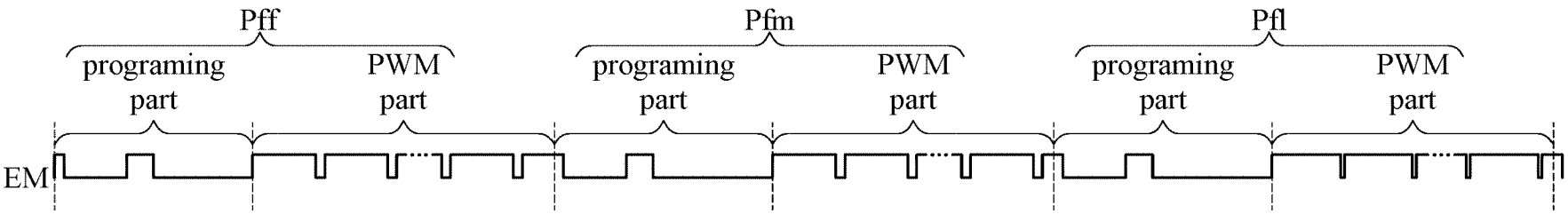

Furthermore, for performing the driving method of the present disclosure, the above illustrated structure wherein the controller 2 has the pre-driving processor 21 and the driving processor 22 is merely an embodiment of the present disclosure and the present disclosure is not limited thereto. Specifically, in an embodiment wherein the controller 2 does not have a pre-driving processor 21, the driving processor 22 detects the change in refresh rate based on the image signal IP and the data enable signal DE and performs the compensation procedure when said change occurs. In this embodiment, the driving processor 22 may still start the compensation procedure early enough to let the emission signal EM have a waveform like what are shown in FIGS. 5A, 5B, 7A and 7B, such as starting the compensation procedure during the programming part of the latter frame period. Said situation may occur when the driving processor 22 detects the change in refresh rate in the former frame period Pff or even in the programming part of the latter frame periods Pfl in FIGS. 5A and 5B or of the middle frame periods Pfm in FIGS. 7A and 7B. However, in this embodiment, since the controller 2 does not have a pre-driving processor 21 to calculate the final duty ratio in advance to the starting of the PWM part of the latter frame period Pfl shown in FIGS. 5A and 5B or the middle frame period Pfm shown in FIGS. 7A and 7B, there may be a middle frame period Pfm having a PWM part with the initial duty ratio as what are shown in FIGS. 8A and 8B. FIGS. 8A and 8B show the waveforms of the emission signal EM in the cases that the driving processor 22 detects the change in refresh rate during the middle frame period Pfm and starts the compensation procedure in the frame period Pf next to the middle frame period Pfm, so that the PWM part of the frame period Pf next to the middle frame period Pfm, such as the latter frame period Pfl in FIG. 8A or 8B, can have the final duty ratio in response to the refresh rate variation. Similarly, although FIGS. 8A and 8B only show adjusting the duty ratio from the initial duty ratio to the final duty ratio immediately, there can still be more than two middle frame periods Pfm between the former frame period Pfm and the latter frame period Pfl for a gradual adjustment in duty ratio.

In view of the foregoing descriptions, by implementing the driving method disclosed in the present disclosure, the change in quantity of light due to refresh rate variation can be compensated by the adjustment in duty ratios of PWM parts of frame periods Pf, so as to reduce the brightness change due to refresh rate variation as much as possible. Furthermore, this driving method not only can be implemented by a controller with two driving processors including a pre-driving processor but also may be carried out by a controller without the pre-driving processor.

What is claimed is:

1. A driving method of light emitting diode (LED) display, configured to be applied to an LED display capable of varying a refresh rate thereof, with the driving method comprising:

controlling an organic light-emitting diode of the LED display by an emission signal having a plurality of frame periods, with each of the frame periods having a PWM part with a duty ratio, wherein the emission signal is divided into the PWM part and a programing part, and a length of the programing part is corresponding to the refresh rate of the LED display;

detecting whether a change in the refresh rate of the LED display exists; and performing a compensation procedure when the change is detected, with the compensation procedure compensating a brightness difference of the organic light-emitting diode occurring due to the change in the refresh rate by adjusting the duty ratio of the PWM part.

2. The driving method of LED display according to claim 1, wherein the change in the refresh rate leads to a variation in the length of the programing pall, and the variation in the length of the programing part and an adjustment of the duty ratio are in a positive correlation.

3. The driving method of LED display according to claim 2, wherein the PWM part has a plurality of on-durations while each on-duration comprises a plurality of fractions, and wherein a difference between the variation in the length of the programing part and a total of changes of the plurality of on-durations due to the adjustment of the duty ratio is within a product of a number of the plurality of on-durations and a time period of the fraction.

4. The driving method of LED display according to claim 3, wherein the total of changes of the plurality of on-durations due to the adjustment of the duty ratio is equal to the variation n the length of the programing part.

5. The driving method of LED display according to claim 1, wherein the refresh rate before detecting whether a change in the refresh rate of the LED display exists is a first refresh rate, the refresh rate with the change is a second refresh rate, the duty ratio before the compensation procedure is an initial duty ratio, and the duty ratio after the compensation procedure is a final duty ratio.

6. The driving method of LED display according to claim 5, wherein there is a middle frame period of the frame periods between a former frame period and a latter frame period of the frame periods, and both of the former and middle frame periods have a PWM part with the initial duty ratio, and the latter frame period has a PWM part with the final duty ratio.

7. The driving method of LED display according to claim 6, wherein the compensation procedure is started during the middle frame period.

8. The driving method of LED display according to claim 5, wherein a former frame period of the frame periods is next to a latter frame period of the frame periods, the former frame period has a PWM part with the initial duty ratio, and the latter frame period has a PWM part with the final duty ratio.

9. The driving method of LED display according to claim 8, wherein the compensation procedure is started during the programing part of the latter frame period.

10. The driving method of LED display according to claim 5, wherein a middle frame period of the frame periods is between a former frame period and a latter frame period of the frame periods, the former frame period has a PWM part with the initial duty ratio, the latter frame period has a PWM part with the final duty ratio, and the middle frame period has a PWM part with a duty ratio between the initial and final duty ratios.

11. The driving method of LED display according to claim 10, wherein the compensation procedure is started during the middle frame period.

12. The driving method of LED display according to claim 1, wherein controlling the organic light-emitting diode of the LED display comprises sending an image signal and a data enable signal to a pre-driving processor at a first timing to selectively generate an informing signal, sending the image signal and the data enable signal to a driving processor at a second timing later than the first timing for at least one frame period, and generating the emission signal based on the image signal and the data enable signal or based on the image signal, the data enable signal, and the informing signal by the driving processor.

13. The driving method of LED display according to claim 12, wherein detecting whether the change in the refresh rate exists is performed by the pre-driving processor, the compensation procedure is performed by the driving processor, and wherein the informing signal is generated when the change is detected.

14. The driving method of LED display according to claim 1, wherein the emission signal is generated by a controller of the LED display and sent to a pixel of the LED display, with said pixel having the organic light-emitting diode.

15. A driving method of LED display, configured to be applied to an LED display capable of varying a refresh rate thereof, with the driving method comprising:

controlling an organic light-emitting diode of the LED display by an emission signal having a plurality of frame periods, with each of the frame periods having a PWM part with a duty ratio, wherein the emission signal is divided into the PWM part and a programing part, and a length of the programing part is corresponding to the refresh rate of the LED display; and changing the duty ratio from an initial duty ratio to a final duty ratio when a change in the refresh rate of the LED display exists.

16. The driving method of LED display according to claim 15, wherein there is a middle frame period of the frame periods between a former frame period and a latter frame period of the frame periods, and both of the former and middle frame periods have a PWM part with the initial duty ratio, and the latter frame period has a PWM part with the final duty ratio.

17. The driving method of LED display according to claim 15, wherein a former frame period of the frame periods is next to a latter frame period of the frame periods, the former frame period has a PWM part with the initial duty ratio, and the latter frame period has a PWM part with the final duty ratio.

18. The driving method of LED display according to claim 15, wherein a middle frame period of the frame periods is between a former frame period and a latter frame period of the frame periods, the former frame period has a PWM part with the initial duty ratio, the latter frame period has a PWM part with the final duty ratio, and the middle frame period has a PWM part with a duty ratio between the initial and final duty ratios.

19. A light emitting display (LED) display, capable of varying a refresh rate thereof, comprising:

an LED panel with a plurality of pixels; and a controller electrically connecting with the pixels, wherein the controller generates an emission signal having a plurality of frame periods and sends the emission signal to one of the pixels, with each of the frame periods having a PWM part with a duty ratio, wherein the emission signal is divided into the PWM part and a programing part, and a length of the programing part is corresponding to the refresh rate of the LED display, and wherein the controller changes the duty ratio from an initial duty ratio to a final duty ratio when a change in the refresh rate of the LED display exists.

20. The LED display according to claim 19, wherein there is a middle frame period of the frame periods between a former frame period and a latter frame period of the frame periods, and both of the former and middle frame periods have a PWM part with the initial duty ratio, and the latter frame period has a PWM part with the final duty ratio.

21. The LED display according to claim 19, wherein a former frame period of the frame periods is next to a latter frame period of the frame periods, the former frame period has a PWM part with the initial duty ratio, and the latter frame period has a PWM part with the final duty ratio.

22. The LED display according to claim 19, wherein a middle frame period of the frame periods is between a former frame period and a latter frame period of the frame periods, the former frame period has a PWM part with the initial duty ratio, the latter frame period has a PWM part with the final duty ratio, and the middle frame period has a PWM part with a duty ratio between the initial and final duty ratios.

23. The LED display according to claim 19, wherein the controller comprises a pre-driving processor and a driving processor, the pre-driving processor electrically connects with the driving processor, the driving processor electrically connects with the pixels, and both of the pre-driving processor and the driving processor are configured to receive an image signal and a data enable signal.

24. The LED display according to claim 23, wherein the pre-driving processor receives the image signal and the data enable signal at a first timing to selectively generate an informing signal, and the driving processor receives the image signal and the data enable signal at a second timing later than the first timing for at least one frame period and generates the emission signal based on the image signal and the data enable signal or based on the image signal, the data enable signal, and the informing signal.

25. The LED display according to claim 23, wherein the pre-driving processor detects whether the change in the refresh rate exists based on the image signal and the data enable and generates an informing signal when the change is detected, and the driving processor changes the duty ratio from the initial duty ratio to the final duty ratio when receiving the informing signal.

* * * * *